US007727130B2

(12) United States Patent
Patti

(10) Patent No.: US 7,727,130 B2
(45) Date of Patent: Jun. 1, 2010

(54) WEIGHT-LIFTING APPARATUS AND METHOD OF ASSEMBLING SAME

(76) Inventor: Philip Patti, 3575 Ridge Rd., Templeton, CA (US) 93465

( * ) Notice: Subject to any disclaimer, the term of this patent is extended or adjusted under 35 U.S.C. 154(b) by 29 days.

(21) Appl. No.: 12/100,293

(22) Filed: Apr. 9, 2008

(65) Prior Publication Data

US 2009/0258766 A1 Oct. 15, 2009

(51) Int. Cl.
*A63B 21/078* (2006.01)

(52) U.S. Cl. ..... 482/104; 482/106; 482/108

(58) Field of Classification Search ..... 482/104–108
See application file for complete search history.

(56) References Cited

U.S. PATENT DOCUMENTS

| | | | | |
|---|---|---|---|---|
| 855,463 | A | 6/1907 | Lemp | |
| 4,738,446 | A | 4/1988 | Miles | |
| D327,517 | S | 6/1992 | Bowman | |
| 5,154,560 | A | 10/1992 | Copito | |
| 5,295,934 | A | 3/1994 | Collins et al. | |
| 5,346,499 | A | 9/1994 | Garenfeld et al. | |
| 5,484,367 | A | 1/1996 | Martinex | |
| 5,628,716 | A | 5/1997 | Brice | |
| D398,676 | S | 9/1998 | Marney | |
| 6,007,268 | A | 12/1999 | Wittington et al. | |
| 6,059,700 | A | 5/2000 | Ellenburg | |
| 2003/0232705 | A1 * | 12/2003 | Harms et al. | 482/108 |
| 2006/0172871 | A1 * | 8/2006 | Cao | 482/106 |
| 2007/0027007 | A1 * | 2/2007 | Frasco | 482/106 |

OTHER PUBLICATIONS

Iron grip barbell company 1567 Sunland lane Costa mesa Ca 92626.*
National fitness trade journa p. 24.*
Welded designh theory and practice Arlington Publishing Co. 2000 Woodland Publishing LTD.*
"Security Locknuts—Designed to hold your business together," Product Brochure, Security Locknut Inc., Chicago, Illinois 60656.

* cited by examiner

*Primary Examiner*—Jerome Donnelly

(57) ABSTRACT

A fixed weight/permanent weight-lifting apparatus including dumbbells and barbells is provided that have an elongated shaft with a centrally located handle and ends having a smaller diameter than the handle, a pre-coated head welded to each of these ends with a centrally located channel connecting its inner face and its outer face and a counter bore machined into its outer face of the head forming an inner collar. The channel has a diameter sufficient to receive the portion of the end of said shaft that extends beyond the inner collar. Each of the inner collars are joined to that portion of the end that extends beyond the collar.

19 Claims, 3 Drawing Sheets

WEIGHT-LIFTING APPARATUS AND METHOD OF ASSEMBLING SAME

BACKGROUND OF THE INVENTION

1. Field of Invention

The present invention relates generally to weight-lifting apparatus and a method of assembling the apparatus, and more particularly to fixed dumbbells and barbells and their assembly for use in light duty environments.

2. Description of the Prior Art

Fixed dumbbells and barbells are those in which the individual weights or heads cannot be added or subtracted by the user, but are permanently fixed to each end of a handle or bar. Fixed dumbbells and barbells have long been used in heavy duty environments such as health clubs, gyms, schools, and YMCAs. In recent years, a fast growing segment of the fitness industry has seen dumbbells and barbells used in light duty environments such as hotels, corporate fitness centers, personal training centers, homes and the like. The goal in assembling such weight-lifting equipment is to employ assembly techniques that coat the heads with a durable, pliable coating and still maintain the overall cost of the equipment used in light duty environments significantly less than the cost for equipment used in heavy environments.

Wilkerson, U.S. Pat. No. 4,538,806 discloses and claims a method of assembling barbells having heads covered with a pliable coating and filled with, for example, metal shot.

There is a need for more efficient and less costly methods for assembling dumbbells and barbells having coated heads than those presently taught in the prior art.

SUMMARY OF THE INVENTION

One embodiment of the present invention is weight-lifting apparatus, which includes (a) an elongated shaft including a centrally located handle and ends having a smaller diameter than the handle, (b) a head pre-coated with a pliable material and welded to each of the ends and having a centrally located channel connecting its inner face with its outer face and a counter bore machined into its outer face of the head forming an inner collar adjacent the outer face, and (c) a welded joint around each circumference of the inner collars and a portion of the end of the shaft extending beyond the collar. The channel has a diameter sufficient to receive the end of said shaft.

The shaft and the heads can both be constructed of a metal selected from the group consisting of steel, cast iron and mixtures thereof.

Another embodiment of the present invention is a method for assembling weight-lifting apparatus, which includes the following steps: (a) providing the elongated shaft described above and the pair of heads described above; (b) pressing each of the heads onto the end of the shaft so that a portion of the end of the shaft extends beyond the outer face; and (c) welding a joint around the inner collars and the portion of the end described above.

DESCRIPTION OF THE PREFERRED EMBODIMENTS

Figure 1:
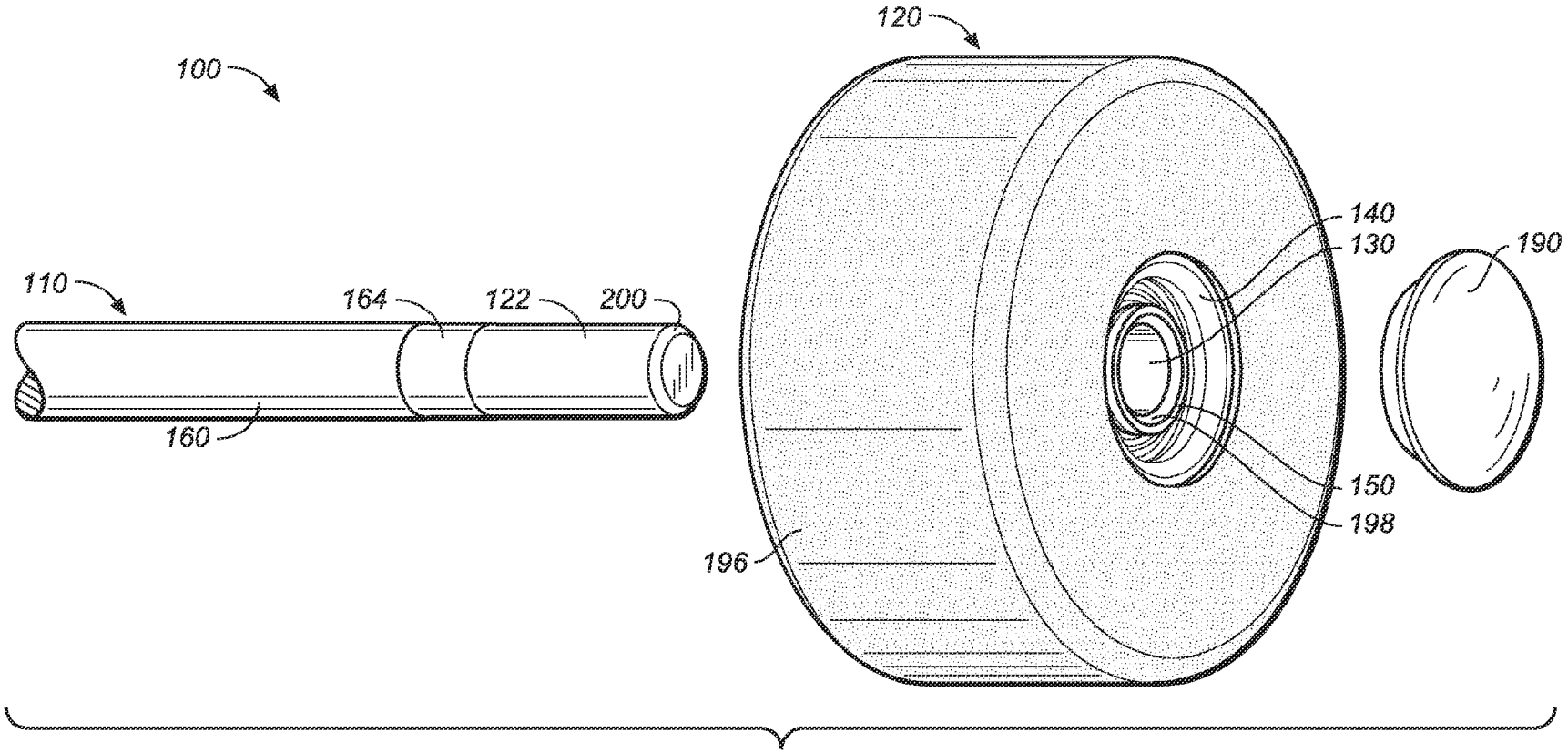
FIG. 1 is an exploded perspective view of the right end of the weight-lifting apparatus of the present invention.
Figure 2A:
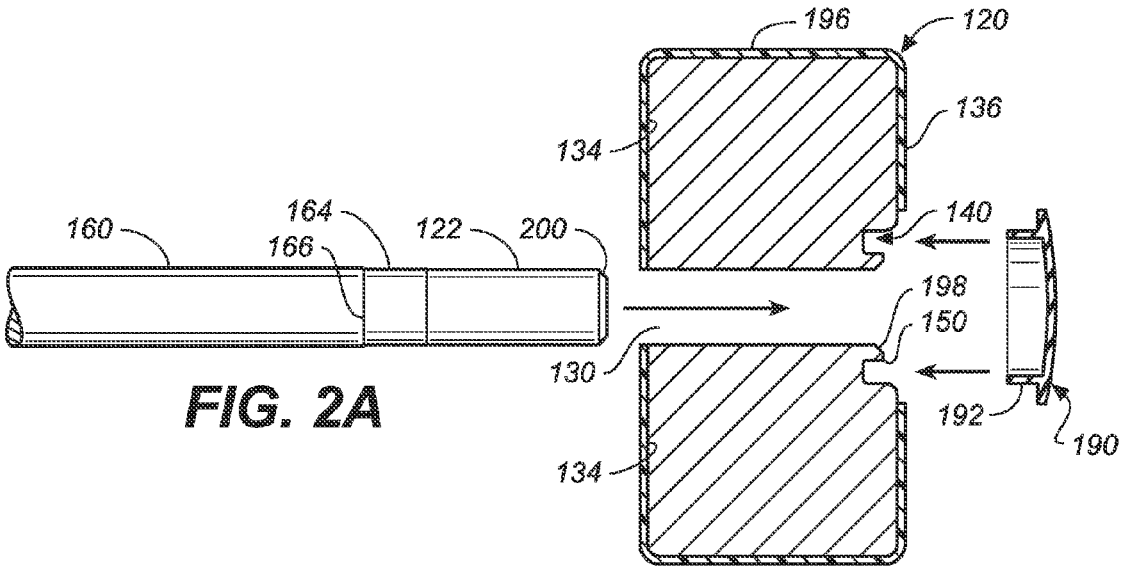
FIG. 2A is a cross sectional view of the right end of weight-lifting apparatus shown in FIG. 1.
Figure 2B:
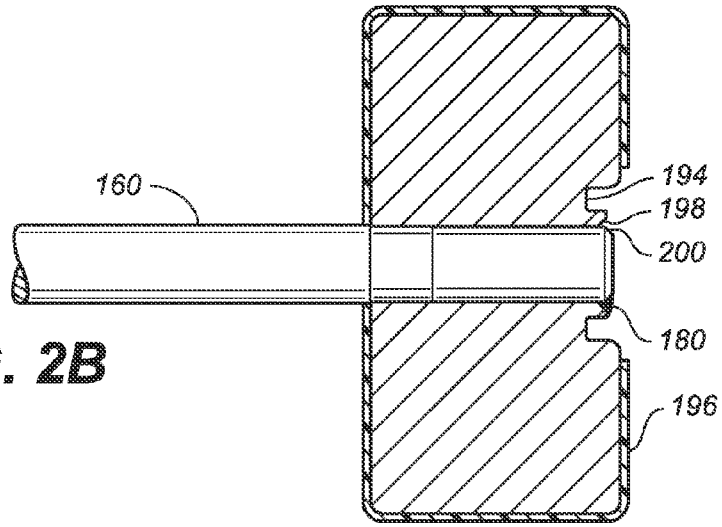
FIG. 2B is a cross sectional view of the right end of weight-lifting apparatus in which the head is shown being assembled onto the shaft and the head being welded to the collar.
Figure 2C:
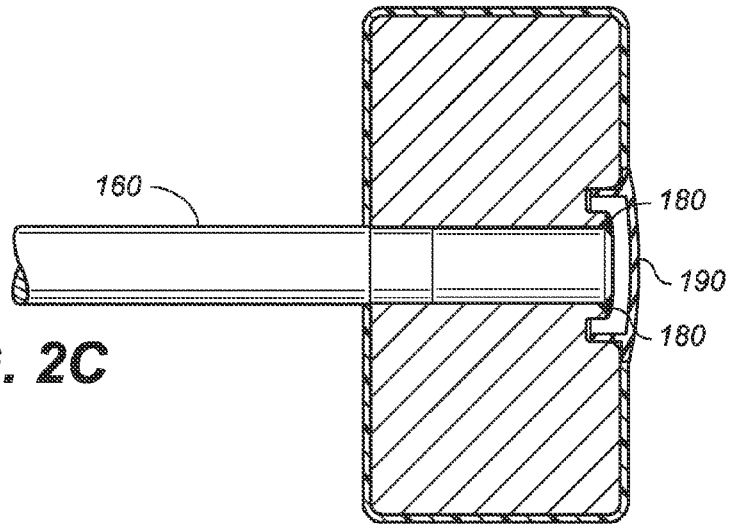
FIG. 2C is a cross sectional view of the right end of weight-lifting apparatus after the assembly has been completed.
Figure 3:
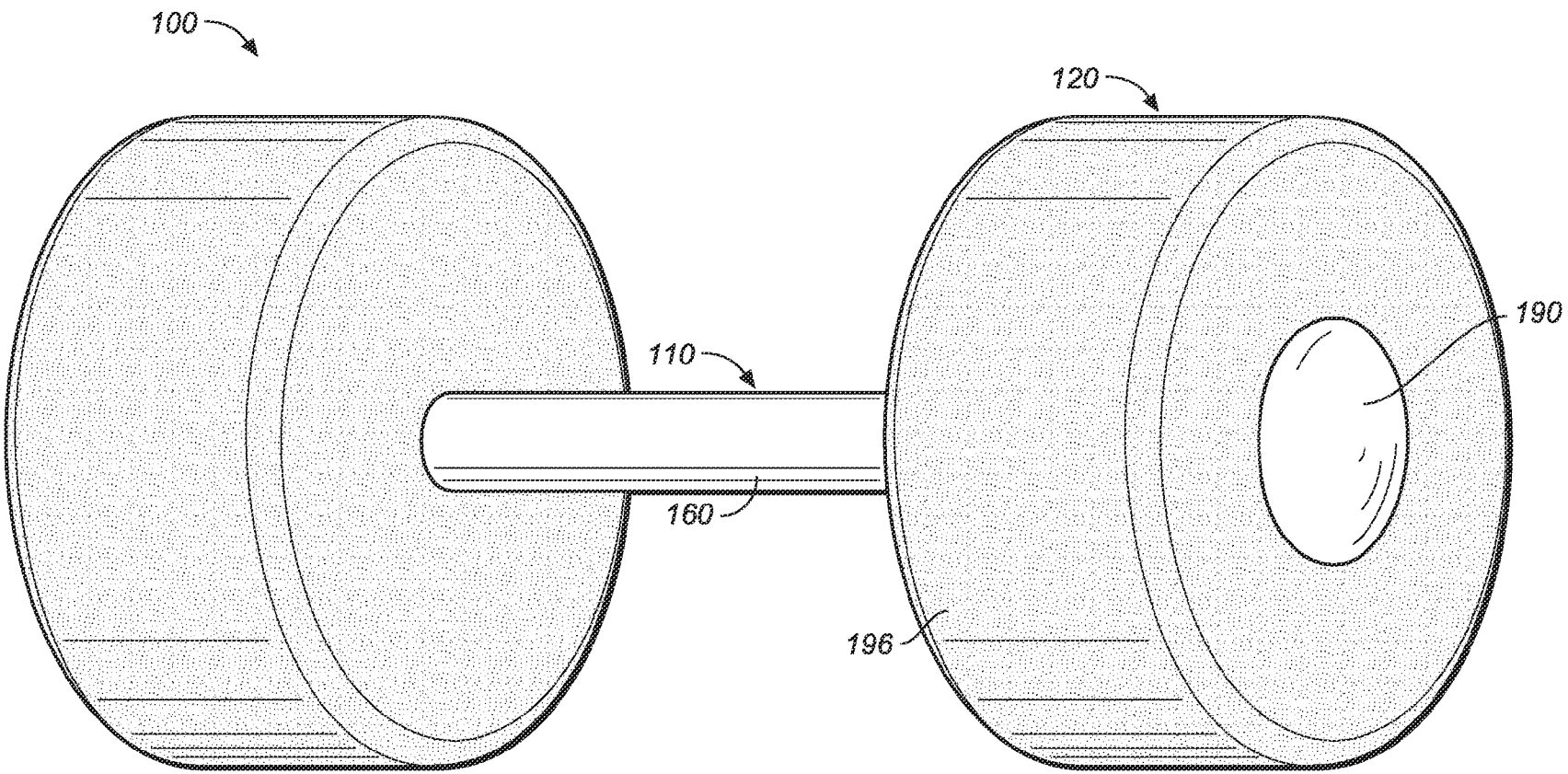
FIG. 3 is a perspective view of the weight-lifting apparatus of the present invention.

Referring now to FIGS. 1-3, weight-lifting apparatus 100 is shown that includes elongated shaft 110, a pair of pre-coated heads 120 at each end 122 of shaft 110. Each head 120 has a centrally located channel 130 extending from inner face 134 toward outer face 136. Counter bore 140 having the same horizontal axis as channel 130 is machined into outer face 136 to form collars 150. Each end 122 has a diameter to fit within channel 130. Between the ends 122 of shaft 110 is a centrally located handle 160 having a diameter larger than ends 122.

In a preferred embodiment of the present invention, a stepped section 164 is formed on shaft 110 between each end 122 and handle 160. Stepped section 164 has a larger diameter than channel 130 to assure a tight fit within channel 130 and a smaller diameter than shaft 110.

FIGS. 2B and 2C show that the entire length of each stepped section 164 has been pressed into channel 130 so that shaft 110 is tightly held within head 120 and the larger diameter portion 166 of handle 160 abuts inner face 134. The length of shaft 110 is designed to allow a portion of each end 122 to extend beyond collar 150. A weld joint 180 joins each collar 150 to the portion of end 122 that extends beyond collar 122.

In another preferred embodiment of this invention, a cap 190, while not essential to the function of weight-lifting apparatus 100, is provided. FIG. 2A shows cap 190 being mounted over each counter bore 140 and channel 130. FIG. 2C shows that after each cap 190 is mounted to each head 120, a sidewall 192 fits within groove 194 so that its outer surface fits tightly against the portion of head 120 adjacent counter bore 140. The cap is constructed of rigid plastic or a similar material that can be removed from equipment 100 in the unlikely event additionally welding is required.

The shaft and the heads can both be constructed of a metal selected from the group consisting of steel, cast iron and mixtures thereof. Preferably they are both constructed of a low carbon, weldable steel such as 1018 steel.

Heads 120 are pre-coated with the desired thickness of a durable, pliable coating 196 such as rubber, polyvinyl and polyurethane using any of a number of prior art molding techniques, e.g., injection, compression and gravity molding.

The present invention permits pre-coating the head and then welding the head to the shaft rather than coating the entire barbell or dumbbell. Prior to the present invention a welded and coated dumbbell or barbell, heads had to be fully welded to the handles before the coating process. Such prior art methods of assembly required very expensive mold tooling due to the size of the molds required to coat a completed dumbbell or barbell after welding.

Pre-coated dumbbell and barbell heads using prior art assembly techniques can not be welded to the handles because the heads must be preheated to steel welding temperatures, preferably in the range of about 300 to 600° C. At such severe temperatures, the coating and any bonding agents would be severely impacted from the heat. In the present invention, the counter bore 140 is machined into outer face136 of head 120 to form collars 150. Counter bore 140 and channel 130 of each head 120 is masked, before head 120 is placed into a mold and coating 196 is applied to the desired thickness. The thickness depends on end use of the weight-lifting apparatus. After coating 196 has been applied, the mask is removed and pre-coated head 120 is ready for assembly.

During the assembly, each end 122 and stepped section 164 of shaft 110 is inserted into channel 130 until a portion of ends 122 protrudes through channel 130 and past collar 150 approximately 0.12 to 0.16 inch. Preferably, chamfur 198 is machined on the inside corner of each collar 150 and a corresponding chamfur 200 is machined on the end 122 to provide extra surface area for the weld. The pre-coated heads 120 are then in a position to be welded to shaft 110.

The amount of clearance of the shaft from the solid head is sufficient to allow the welder to fuse the two metals together without preheating the head. This is achieved because the collar is thin enough and protrudes away from the head so that the collar easily fuses to end 122 without the necessity of preheating the collar. An additional advantage of this technique is that the shaft assists the cooling process by drawing the heat away from the head and back through the entire shaft. The result is that the head never reaches a high enough temperature to impair a pre-coated head.

One advantage of the method of the present invention is that mold tooling is limited to the much less expensive single head molds. Another advantage of the present method is that the handle is not being welded to a corresponding surface of the heads. One prior art method welds the handle to a corresponding inside area in the heads, which creates a heat affected zone at the weld zone. To insure safety, time consuming and very costly X-ray testing is required to see if such a zone caused by the welding process has compromised the original strength of the handle. Another prior art method welds the handle ends to the outer face of the heads and the welds are usually ground or machined off flush with the heads. This method is also very costly. In both these prior art methods, preheating to high temperatures is essential to ensure fusion of the handle to the heads. Pre-coating of the heads is not possible with all of these prior art methods. The overall method of the present invention is a much less expensive and faster than prior art methods and results in barbells and dumbbells that have a high degree of safety.

The weight-lifting apparatus of the present invention includes fixed weight/permanent weight dumbbells and barbells. In case of dumbbells, a user's hands are placed around the center section or handle of a pair of dumbbells. The handle of a dumbbell is usually approximately 5½-6 inches long. In the case of a barbell, both of the user's hands are placed on the handle, which has a length of approximately 36 to 48 inches. The handles in each case can be coated or knurled and plated. The handles are knurled to allow for a better fit for the user's hand.

Without departing from the spirit and scope of this invention, one of ordinary skill in the art can make many other changes and modifications to the weight-lifting apparatus the present invention to adapt to specific uses and conditions. As such, these changes and modifications are properly, equitably and intended to be, within the full range and equivalence of the following claims.

What is claimed is:

1. Weight-lifting apparatus comprising:

a) an elongated shaft including a centrally located handle and ends having a smaller diameter than the handle;

b) a pre-coated head welded to each end of said shaft and having a centrally located channel extending from its inner face towards its outer face and a counter bore machined into its outer face forming a groove and an inner collar between the channel and the groove and protruding away from the head, the channel has a diameter sufficient to receive the end of said shaft that extends beyond the inner collar; and c) a welded joint around each circumference of the inner collars and each of the portions of the end that extends beyond the collar.

2. The weight-lifting apparatus of claim 1, wherein a cap for each of the heads is mounted over the counter bore to cover the counter bore and the channel.

3. The weight-lifting apparatus of claim 1, wherein stepped sections are positioned between the handle and the ends, the sections having a smaller diameter than the handle and a larger diameter than the ends.

4. The weight-lifting apparatus of claim 1, wherein said shaft and said heads are constructed of steel.

5. The weight-lifting apparatus of claim 4, wherein said steel is a low carbon, weldable steel.

6. The weight-lifting apparatus of claim 1, wherein the heads are pre-coated with a pliable material selected from the group consisting of rubber, polyurethane, polyvinyl and mixtures thereof.

7. The weight-lifting apparatus of claim 1, wherein the handle is knurled.

8. The weight-lifting apparatus of claim 2, wherein said cap is constructed of a pliable material.

9. The weight-lifting apparatus of claim 1, wherein each of said heads is constructed of a solid block of metal.

10. The weight-lifting apparatus of claim 1, wherein the inside edge of each of the collars is chamfered and each of the portions of the end of said shaft that extends beyond the collar is chamfered to correspond to the chamfer on the collar, and said head has a tensile strength in the range of about 55,000 to about 75,000 psi.

11. A method of assembling weight-lifting apparatus comprising the steps of:

a) providing:

i) an elongated shaft including a centrally located handle and ends having a smaller diameter than said shaft, and ii) a pre-coated head welded to each end of said shaft and having a centrally located channel extending from its inner face towards its outer face and a counter bore machined into its outer face forming a groove and an inner collar between the channel and the groove and protruding away from the head, the channel has a diameter sufficient to receive the end of said shaft that extends beyond the inner collar;

b) pressing each of said heads onto the end of said shaft so that a portion of the end of said shaft extends from the inner face of said head to beyond the inner collar; and c) welding a joint to join each circumference of the inner collars with each of the portions of the ends of said shaft extending beyond the inner collar.

12. The method of claim 11, wherein a cap is mounted on each of said heads to cover the counter bore and the channel.

13. The method of claim 11, wherein stepped sections are positioned between the handle and the ends, the sections having a smaller diameter than the handle and a larger diameter than said ends.

14. The method of claim 11 wherein said shaft and said heads are constructed of steel.

15. The method of claim 14, wherein said steel is a low carbon, weldable steel.

16. The method of claim 11 wherein the heads are precoated with pliable material selected from the group consisting of rubber, polyurethane, polyvinyl and mixtures thereof.

17. The method of claim 11, wherein the handle is knurled.

18. The method of claim 11, wherein the counter bore is machined into the head, the counter bore is masked, the head is coated with a pliable material and the mask is removed prior to step (b).

19. The method of claim 11, wherein the inside edge of each of the collars is chamfered and each of the portions of the ends of said shaft that extends beyond the collar is chamfered to correspond to the chamfer on the collar.

* * * * *